US010094120B2

(12) United States Patent
Preston

(10) Patent No.: US 10,094,120 B2
(45) **Date of Patent: *Oct. 9, 2018**

(54) ROOF VENTING ARRANGEMENT AND METHOD

(71) Applicant: Dura-Ply Roofing Corporation, Addison, IL (US)

(72) Inventor: Thomas J. Preston, Glen Ellyn, IL (US)

(73) Assignee: Dura-Ply Roofing Corporation, Addison, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/402,793

(22) Filed: Jan. 10, 2017

(65) Prior Publication Data

US 2017/0234013 A1 Aug. 17, 2017

Related U.S. Application Data

(63) Continuation of application No. 13/554,801, filed on Jul. 20, 2012, now Pat. No. 9,556,617.

(51) Int. Cl.
*E04D 13/17* (2006.01)

(52) U.S. Cl.
CPC ..... *E04D 13/17* (2013.01); *E04D 13/172* (2013.01)

(58) Field of Classification Search
CPC ... E04D 3/40; E04D 13/0477; E04D 13/1681; E04D 13/1687; E04D 13/17; E04D 13/172; E04B 1/70; E04B 9/02; E04B 7/22
USPC ..... 52/302.1, 302.3, 199
See application file for complete search history.

(56) References Cited

U.S. PATENT DOCUMENTS 859,954 A * 7/1907 Leser ..... E04B 1/7069 52/302.3
1,931,066 A * 10/1933 Eckert ..... E04D 13/17 454/185
3,066,596 A * 12/1962 Gray ..... F23L 17/10 454/18
3,756,895 A * 9/1973 Bellamy ..... E04D 5/12 156/257
3,797,374 A * 3/1974 Jones ..... F24F 7/02 416/186 R
3,817,009 A * 6/1974 Elder ..... E04D 13/143 52/173.1
3,893,383 A * 7/1975 Jones ..... F23L 17/10 416/178
3,984,947 A * 10/1976 Patry ..... E04D 13/17 52/1
4,221,096 A * 9/1980 Viertlboeck ..... E04D 5/142 52/199

(Continued)

OTHER PUBLICATIONS

Applicant's Admitted Prior Art submitted on Aug. 20, 2013.*

*Primary Examiner* — Rodney Mintz
(74) *Attorney, Agent, or Firm* — Erickson Law Group, PC

(57) ABSTRACT

A venting method and arrangement for a roof includes a plurality of venting stacks each having a first open base end open to an area on top of the roof insulation layer and below the roof outer membrane, the venting stacks arranged spaced apart around a perimeter of the roof. A venting path grid of air permeable material is arranged between the roof membrane and the insulation layer. The grid is in air flow communication with the first open base ends. Centrally located wind-driven turbine ventilators can also be in air flow communication to the grid.

18 Claims, 3 Drawing Sheets

(56) References Cited

U.S. PATENT DOCUMENTS 4,223,486 A * 9/1980 Kelly ..... E04D 13/17 52/1
4,490,952 A * 1/1985 Winston ..... E04D 13/17 52/199
4,512,243 A * 4/1985 Ballard ..... B21D 53/00 454/339
4,538,388 A * 9/1985 Friesen ..... E04D 13/17 52/199
4,538,508 A * 9/1985 Ballard ..... B21D 53/00 137/852
4,557,081 A * 12/1985 Kelly ..... E04D 5/14 52/199
4,593,504 A * 6/1986 Bonnici ..... E04D 13/17 454/347
4,608,792 A * 9/1986 Gerber ..... E04D 13/17 454/240
4,805,367 A * 2/1989 Kleckner ..... E04D 13/17 52/199
4,850,166 A * 7/1989 Taylor ..... E04D 13/17 454/368
4,888,930 A * 12/1989 Kelly ..... E04D 3/3601 52/309.8
4,909,135 A * 3/1990 Greko ..... E04D 13/17 454/339
5,749,780 A * 5/1998 Harder ..... E04D 13/1407 236/49.5
6,234,198 B1 * 5/2001 Chalich ..... F16K 24/06 137/526
6,302,778 B1 * 10/2001 Andrews ..... F03D 3/005 454/16
6,352,473 B1 * 3/2002 Clark ..... F23L 17/10 454/18
7,001,266 B2 * 2/2006 Jones ..... E04D 5/14 454/364
7,607,974 B2 * 10/2009 Jones ..... E04D 13/17 454/364
8,978,342 B2 * 3/2015 Pascoe ..... E04D 13/172 52/198
9,556,617 B2 * 1/2017 Preston ..... E04D 13/17
2014/0020313 A1 * 1/2014 Preston, III ..... E04D 13/17 52/199
2014/0123579 A1 * 5/2014 Pascoe ..... E04D 13/172 52/198
2016/0177574 A1 * 6/2016 Keene ..... E04D 13/178 52/11

* cited by examiner

ROOF VENTING ARRANGEMENT AND METHOD

This application is a continuation of U.S. Ser. No. 13/554,801 filed Jul. 20, 2012.

BACKGROUND OF THE INVENTION

The present invention relates generally to roof ventilating systems, and particularly to roof ventilating systems for commercial and industrial buildings, that typically have substantially flat roofs.

A typical commercial roof includes a structural roof deck, covered by a vapor barrier. A layer of insulation is placed over the vapor barrier. An impermeable synthetic plastic roofing membrane is placed over the insulation. Water leaks from above the membrane may wet the insulation or water from inside the building may condense between the vapor barrier and the plastic roofing membrane and wet the insulation. Wet insulation has a reduced heat transfer resistance and can degrade.

Vents are used above the building roof membrane to vent the space between the membrane and the vapor barrier. With effective roof venting, wet roofs can be dried over a period of time.

Another problem with membrane covered flat roofs is that a strong wind flowing across the membrane creates a suction that tends to lift the membrane up off of the roof structure. The present inventor has recognized that roof vents, if in air flow communication with the space beneath the membrane, transfer the suction force caused by the wind to an underside of the membrane and tends to pull the membrane down onto the roof structure in the vicinity of the vent.

SUMMARY OF THE INVENTION

The present invention provides a roof venting grid applied to a substantially flat roof that not only effectively dries wet insulation between a roof membrane and the vapor barrier, but also effectively holds down the roof membrane to the roof against high winds.

The present invention provides at least one lengthwise vapor path that extends substantially along a length of the roof and having a roof vent flow connected to the vapor path at each end of the vapor path. Furthermore the invention can have at least one widthwise vapor path that intersects the lengthwise vapor path and spans substantially the width of the roof and having a roof vent at either end of the widthwise vapor path.

Preferably, the invention provides a plurality of spaced apart lengthwise vapor paths and a plurality of spaced apart widthwise vapor paths, the widthwise vapor paths intersecting the lengthwise vapor paths and each of the lengthwise and widthwise vapor is paths having a vent at opposite ends thereof. Also preferably, vents can also be located at the intersections of the lengthwise and widthwise vapor paths. Preferably, the vents at the intersections are turbine style vents.

According to another aspect, the vents are arranged around a perimeter of the building roof. Additional vents can be applied in corners of the building roof. The vents are all connected to a grid of vapor paths.

The vapor paths constitute open mesh fabric or mesh filter material. The open mesh fabric is fit on top of the insulation and below the upper membrane.

Numerous other advantages and features of the invention will become readily apparent from the following detailed description of the invention and the embodiments thereof, from the claims, and from the accompanying drawings.

DETAILED DESCRIPTION

Figure 1:
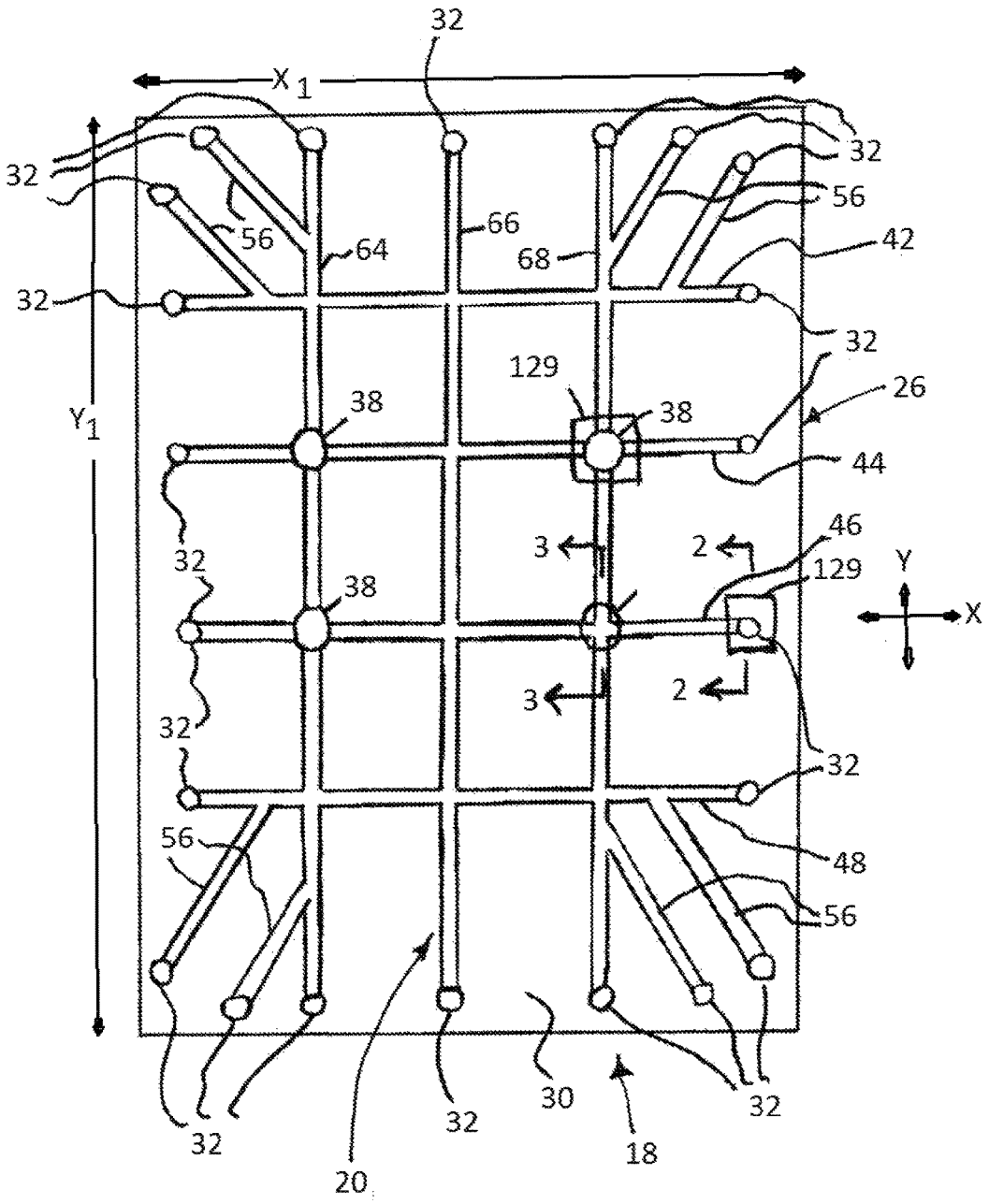
FIG. 1 is a schematic plan view of a flat building roof.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 schematically illustrates a building 18 having venting system 20 arranged on a flat building roof 26. The roof 26 has a lengthwise dimension Y1 of about 150 feet and a widthwise dimension X1 of about 100 feet. The flat roof is substantially covered on a top side by a membrane 30, typically EPDM material (ethylene propylene diene monomer). The venting system 20 illustrated includes twenty perimeter roof vents 32 and eight central turbine vents 38. Each vent, 32, 38 can be supported on a base mesh fabric 129 described below, although only two are shown in FIG. 1 for simplicity. Four transverse pathways 42, 44, 46, 48 extend across the roof 20. Each pathway includes a perimeter roof vent on each end and a pair of turbine vents 38 between the two roof vents. The remaining roof vents each are in communication with one of twelve tributary pathways 56 that communicate with either the first transverse pathway 42 or the fourth transverse pathway 48. Interior connecting pathways 66, 68 each connect to four turbine vents 38 that are substantially aligned. The pathways 56, 42, 44, 46, 48, 66 and 68 form a grid of pathways that substantially cover the roof top in both the X and Y directions.

The vapor paths 56, 42, 44, 46, 48, 66 and 68 are formed by open mesh fabric or filter material such as mesh material designated C06.03, at ⅞ inch thickness; 1 SB10, at 1⅛ inch thickness; or 1 ECO, at 1 inch thickness, all available from Superior Fibers Inc. of Bremen, Ohio, US. The open mesh fabric is fit on top of the insulation and below the upper membrane 30 or below the vents 32, 38. The open mesh fabric allows air or vapor to pass horizontally through the fabric and vertically through the fabric. The vapor paths 56, 42, 44, 46, 48, 66 and 68 preferably have a width between 9 and 12 inches wide, and more preferably 10 inches wide. The mesh fabric of the vapor paths can be secured to the insulation by insulation block fasteners and/or by adhesive or sealant.

Figure 2:
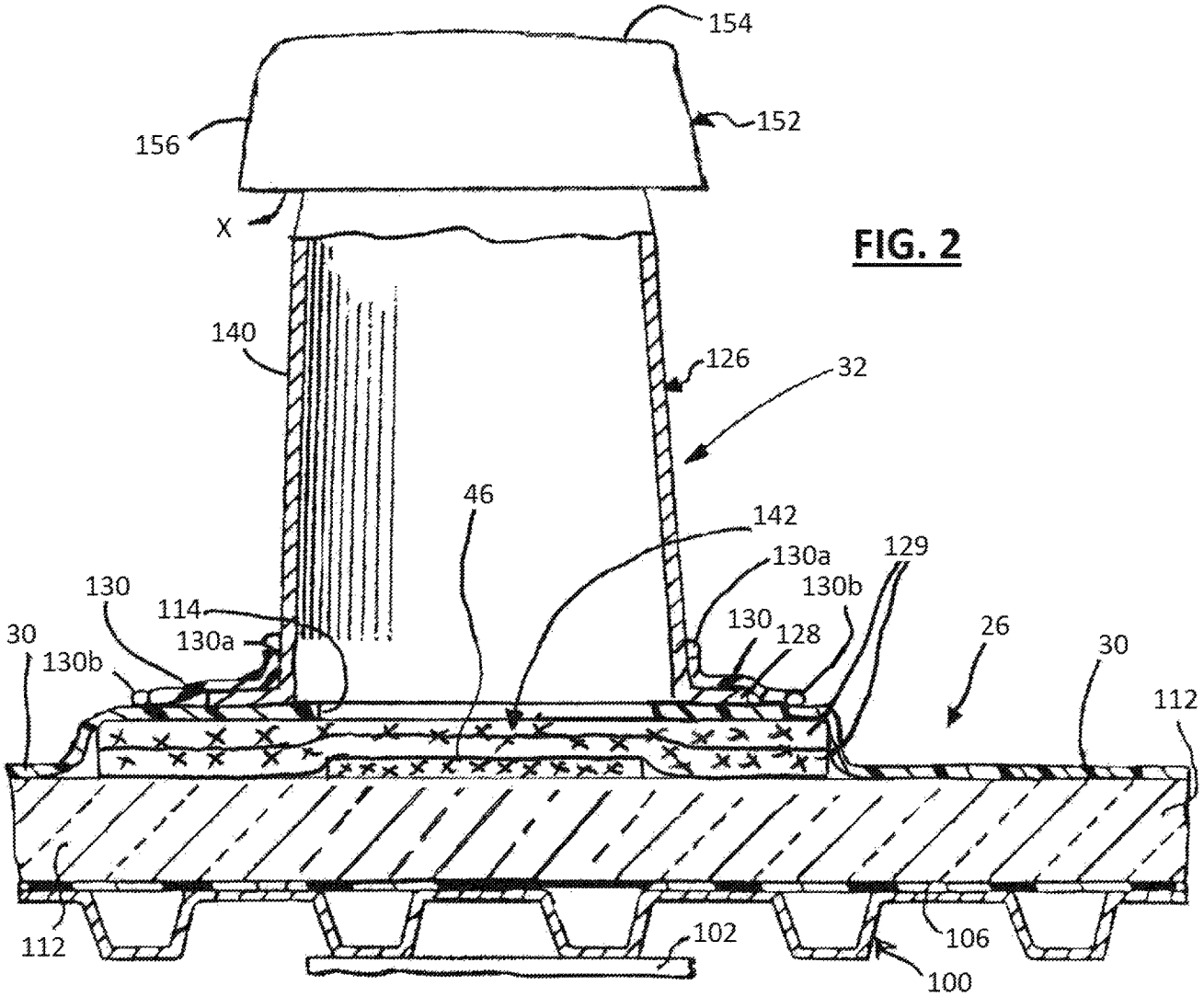
FIG. 2 is a sectional view taken generally along line 2-2 of FIG. 1.

Referring to FIG. 2, the roof 26 may typically consist of an interior metal or wood building deck 100, supported on roof purlins 102 which are part of a typical commercial building's frame structure. A near impermeable vapor barrier sheet 106, covers the building deck 100. Rigid fibrous or foam insulation boards or blocks 112 are provided between the barrier sheet 106 and the outer roof covering membrane 30. Membrane 30 has an opening 114 in air flow communication with the vent 32.

The vent 32 is more particularly described in U.S. Pat. No. 4,909,135, herein incorporated by reference. The vent 32 is fabricated in two component parts and, as shown, these parts include an upwardly extending open-ended tube 126 formed at its lower end with a radially outwardly extending annular flange 128. The flange 128 is supported on one or more layers of a base mesh fabric 129, which can be approximately 2 feet by 2 feet, and overlies the path 46 of mesh fabric. The flange 128 can be adhesively secured to the base mesh fabric 129. The base mesh fabric 129 can be composed of one or more layers of mesh material K02.03, at 1½ inch thickness per layer and available from Superior Fibers Inc. of Bremen, Ohio, USA. The base mesh fabric is air permeable vertically and can be air permeable horizontally as well. The base mesh fabric must support the vent while at the same time not becoming too compressed by the weight of the vent to adversely affect its air permeability. The base mesh fabric can be secured to the insulation by block insulation fasters and/or by adhesive or sealant. The skirt 130 typically composed of cured EPDM wide cover tape is adhered onto the membrane 30 around the vent and sealed by calk or sealant around its inside and outside perimeter to the tube 126 and to the membrane 30. The tape of the skirt 130 can be applied in two strips and sealed along its seem to form approximately a 2 foot by 2 foot skirt.

As shown in FIG. 2, the tube structure 126 has an upwardly tapered peripheral wall portion 140, terminating to leave a top opening (not shown) in the upper end of tube 126. The lower end of tube 126 is open to a space 142, provided above the insulation blocks 112 and occupied by the pathway 46 of mesh fabric and the base mesh fabric 129.

A cap or hood, generally designated 152, is provided for the upper end of the tube or stack 126 to prevent the entry of rain, snow and the like, and comprises a top wall 154 spaced above the top opening of the tube 126, and has a downwardly divergent peripheral wall 156 extending generally parallel to wall portion 140 but overhanging the wall 140.

When wind is present, an air stream traveling up between the walls 140 and 156 is converged by the fins within the hood 152, such that its velocity is increased, and a venturi suction is created tending to pull an air current upwardly out of the tube 126. The air pulled upwardly out of tube 126 is then moved outwardly, along the path "x."

The vent 32 can alternately be constructed according to U.S. Pat. Nos. 6,234,198; 5,749,780; 4,593,504; or 3,984,947 which are all herein incorporated by reference. The roof vents in these patents incorporate a one way valve to allow air or vapor to exit the vent to ambient, but closes to prevent outside air from entering the vent 32 and flowing into the space between the membrane 30 and the barrier 106.

Figure 3:
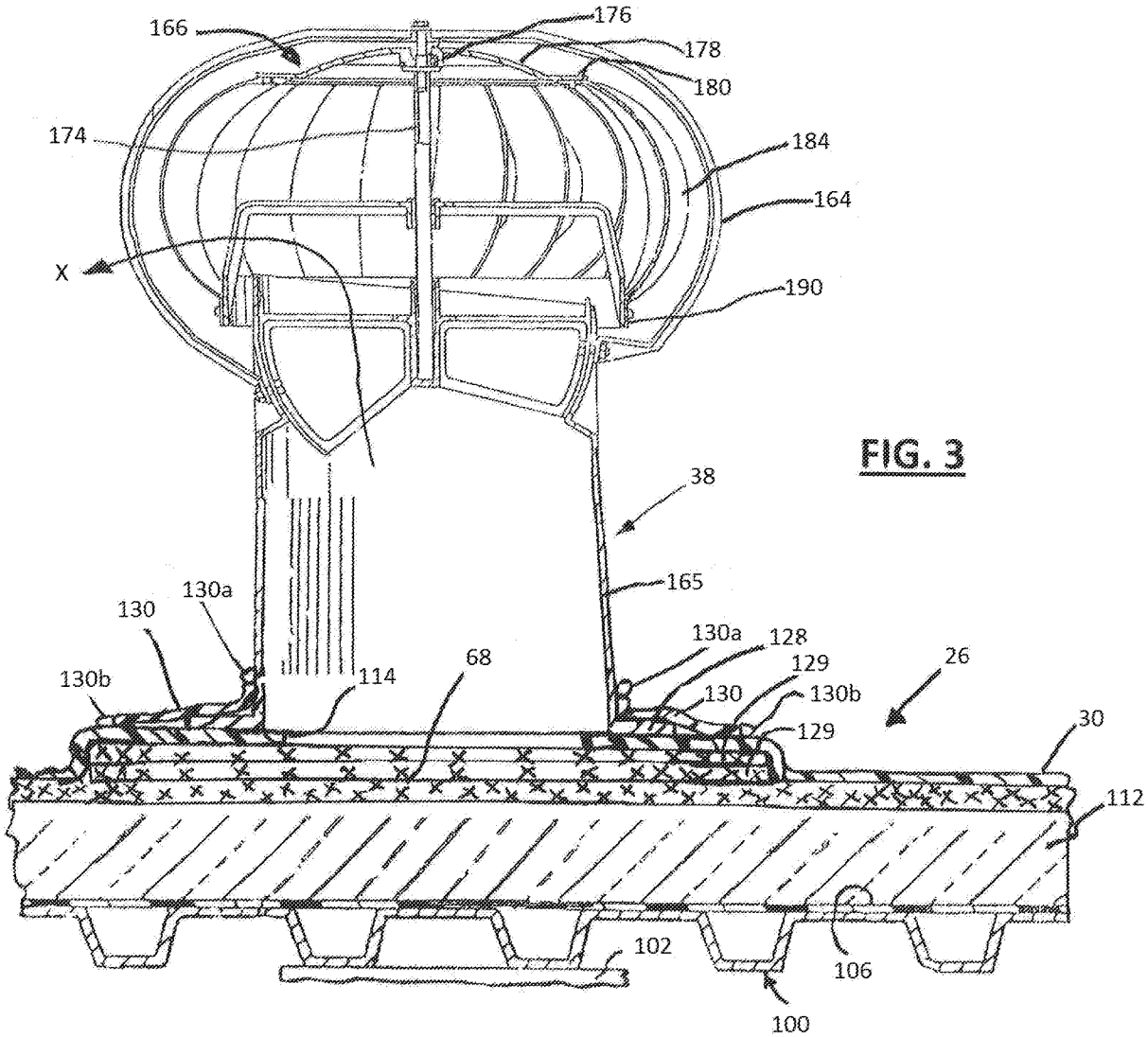
FIG. 3 is a sectional view taken generally along line 3-3 of FIG. 1.

FIG. 3 illustrates a typical turbine style vent 38. The vent depicted can be constructed in accordance with U.S. Pat. Nos. 3,893,383 or 3,797,374, herein incorporated by reference. The vent 38 can also be constructed according to U.S. Pat. Nos. 3,066,596; 6,352,473 or 6,302,778 all herein incorporated by reference.

The vent 38 includes a turbine ventilator 164 mounted on an open-ended tube or stack 165. The turbine ventilator 164 comprises a rotatable turbine 166 mounted on a shaft 174. The shaft is stationary and supports the turbine 166 on a bearing assembly 176. The bearing assembly is received in a socket or recessed opening on the lower side of a bonnet 178. The bonnet 178 covers the top portions of the turbine 166. The bonnet 178 is curved and approximates a segment of a sphere although it need not be precisely spherical in shape. It extends outwardly to a flat portion or encircling lip 180. The lip 180 is preferably in a single plane which is perpendicular to the shaft 174 which supports the turbine 166.

The bonnet 178 supports a number of ribs 184. There are many ribs, and they are preferably arranged evenly around the bonnet 178. They all extend downwardly to a ring 190. Rotation of the turbine 166, particularly the ribs, causes air or vapor to be drawn up the open ended tube 165 along the path x.

The stack 165 is installed onto the roof in identical fashion as the stack 126 shown in FIG. 2 and supported on one or more layers of base mesh fabric 129 that overlies the path 68 of mesh fabric.

Each of the vents 32 is installed in similar fashion to that shown in FIG. 2 and each of the vents 38 is installed in similar fashion to that shown in FIG. 3. Each of the vents 32, 38 is supported on, and in air flow communication with, one or ore layers of a base mesh fabric 129 which is in air flow communication with a path of mesh fabric such as to exert an upward suction through the base mesh fabric 129 and the particular path depending on the wind condition on the roof.

The vapor paths 56, 42, 44, 46, 48, 66 and 68, allow air to be drawn though one or more of the turbine ventilators 38 and/or one or more of the vents 32 to dry out wet insulation and also to hold down the membrane 30 tightly to the insulation 112. Because each path has two or more vents 32, 38 in air flow communication with the pathways, any wind direction across the roof assists in drying large portions of the roof and assists in holding down the roof membrane.

Because of the interconnection of the paths 56, 42, 44, 46, 48, 66 and 68 an overall drying of the insulation 112 can be achieved no matter the wind direction. Because of the interconnection of the paths 56, 42, 44, 46, 48, 66 and 68 an overall hold down of the membrane 30 to the insulation 112 can be achieved no matter the wind direction.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A venting arrangement for a roof, the roof having an insulation layer and a roof membrane on top of the insulation layer, the arrangement comprising:

a plurality of perimeter venting stacks arranged spaced-apart around a perimeter of the roof, each said perimeter venting stack having a first open base end that is open to an area on the top of the insulation layer and below the roof membrane; and a plurality of venting paths forming a grid on the roof, each said venting path comprising filter material that allows air to pass horizontally and vertically through the filter material, the filter material arranged between the roof membrane and the insulation layer and extending lengthwise or widthwise across the roof and open at opposite ends to respective said first open base ends of the perimeter venting stacks located adjacent to opposite sides of the roof;

wherein the filter material includes mutually interconnected voids which provide a sufficient air permeability such that ambient air flow on the roof past one of the plurality of venting stacks draws vapor through a respective said venting path and creates a suction to urge the roof membrane down onto the insulation layer, and wherein the filter material does not transport said vapor by capillary action.

2. The venting arrangement according to claim 1, wherein the filter material has a width of between 9 and 12 inches.

3. The venting arrangement according to claim 1, further comprising intermediate venting stacks located at intermediate positions along each said venting path, each said intermediate venting stack having a second open base end that is open to the area on the top of the insulation layer and below the roof membrane.

4. The venting arrangement according to claim 3, wherein said each intermediate venting stack comprises a wind driven impeller for drawing air up the intermediate venting stack from the second open base end.

5. The venting arrangement according to claim 1, wherein each said venting stack is supported on a base mesh fabric that overlies a respective said venting path.

6. The venting arrangement according to claim 5, wherein each said base mesh fabric has an outer perimeter greater than a perimeter of the respective first open base end that is supported on the base mesh fabric.

7. The venting arrangement according to claim 6, wherein said each base mesh fabric has a widthwise dimension of about 2 feet.

8. A venting arrangement for a roof, the roof having an insulation layer and a roof membrane on top of the insulation layer, the arrangement comprising:

a plurality of perimeter venting stacks arranged spaced-apart around a perimeter of the roof, each said perimeter venting stack having a first open base end that is open to an area on the top of the insulation layer and below the roof membrane;

a plurality of venting paths forming a grid on the roof, each said venting path comprising filter material that allows air to pass horizontally and vertically through the air filter material, the filter material arranged between the roof membrane and the insulation layer and extending lengthwise or widthwise across the roof and open at opposite ends to respective said first open base ends of the perimeter venting stacks located adjacent to opposite sides of the roof;

wherein said each venting stack is supported on a base mesh fabric that allows air to pass vertically through the base mesh fabric that overlies a respective said venting path;

wherein each said base mesh fabric has an outer perimeter greater than a perimeter of the respective first open base end that is supported on the base mesh fabric;

wherein the filter material includes mutually interconnected voids which provide a sufficient air permeability such that ambient air flow on the roof past one of the plurality of venting stacks draws vapor through the respective venting path and creates a suction to urge the roof membrane down onto the insulation layer, and wherein the filter material does not transport said vapor by capillary action.

9. The venting arrangement according to claim 8, wherein said each base mesh fabric has a widthwise dimension of about 2 feet.

10. The venting arrangement according to claim 8, wherein the filter material has a width of between 9 and 12 inches.

11. A method of venting a roof, the roof having an insulation layer and a roof membrane on top of the insulation layer, the method comprising:

arranging a first venting stack having a first open base end open to an area on the top of the insulation layer and below the roof membrane;

arranging an air venting path between the roof membrane and the insulation layer and in air flow communication at a first location to the first open base end of the first venting stack and extending to a second location away from the first venting stack; and arranging a second venting stack having a second open base end open to the area on the top of the insulation layer and below the roof membrane, the air venting path being in said air flow communication at the second location to the second open base end of the second venting stack;

wherein the air venting path includes mutually interconnected voids which provide a sufficient air permeability such that ambient air flow on the roof past the first or second venting stacks draws vapor from the insulation layer vertically into the air venting path and horizontally through the air venting path and creates a suction to urge the roof membrane down onto the insulation layer, and wherein the air venting path does not transport said vapor by capillary action.

12. The method according to claim 11, comprising the further steps of:

arranging a plurality of additional third venting stacks each having a first open base end open to the area on the top of the insulation layer and below the roof membrane, the additional third venting stacks arranged spaced apart around a perimeter of the roof;

arranging an air venting path grid between the roof membrane and the insulation layer and in air flow communication to the first open base ends of the plurality of additional third venting stacks and to the air venting path.

13. The method according to claim 11, comprising the further steps of: arranging a first base mesh fabric supporting the first open base end and overlying the air venting path and arranging a second base mesh fabric supporting the second open base end and overlying the air venting path.

14. The method according to claim 11 wherein the step of arranging the air venting path is further defined by arranging an air permeable open mesh fabric between the roof membrane and the insulation layer.

15. The method according to claim 14 wherein the air venting path has a width of between 9 and 12 inches.

16. The method according to claim 11, wherein the step of arranging the second venting stack is further defined in that the second venting stack comprises a wind-driven turbine for drawing air up the second venting stack from the second open base end.

17. The method according to claim 16, wherein the step of arranging the air venting path is further defined in that the air venting path extends from the second location away from the first location to a third location; and comprising the further step of arranging a third venting stack having a third open base end open to the area on the top of the insulation layer and below the roof membrane, the air venting path open at the third location to the third open base end of the third venting stack.

18. The method according to claim 17, wherein the steps of arranging the first and second venting stacks are further defined in that the first and second locations are adjacent opposite sides of the roof and the second location is in a central location of the roof.

* * * * *